United States Patent [19]

Mähler et al.

[11] 4,255,878

[45] Mar. 17, 1981

[54] COMBINATION PLOUGH

[75] Inventors: Oscar Mähler, Fack; Lars Furberg, Risgatan, both of Sweden

[73] Assignee: AB Mahler & Soner, Rosson, Sweden

[21] Appl. No.: 3,424

[22] Filed: Jan. 9, 1979

[30] Foreign Application Priority Data

Jan. 12, 1978 [SE] Sweden ..... 7800355

[51] Int. Cl.[3] ..... E01H 5/04

[52] U.S. Cl. ..... 37/42 VL

[58] Field of Search ..... 37/41, 42 R, 42 VL, 37/50

[56] References Cited

U.S. PATENT DOCUMENTS 3,808,714 5/1974 Reissinger et al. ..... 37/42 VL

FOREIGN PATENT DOCUMENTS 264572 10/1968 Austria ..... 37/42 VL
2230274 10/1973 Fed. Rep. of Germany ..... 37/42 VL
2617235 10/1977 Fed. Rep. of Germany ..... 37/42 VL
1949832 11/1977 Fed. Rep. of Germany ..... 37/42 VL
1901794 12/1977 Fed. Rep. of Germany ..... 37/42 VL

*Primary Examiner*—E. H. Eickholt
*Attorney, Agent, or Firm*—Cushman, Darby & Cushman

[57] ABSTRACT

A plough assembly of the kind which during use is raised and lowered relative to a surface to be ploughed or cleared: is provided having a wing with a forwardly facing surface and a lower edge; a steel share carried by the wing adjacent the lower edge thereof, the steel share having a lower scraping edge permanently disposed below the lower edge of the wing; a mud share pivotally connected to the wing for swinging movement about a generally horizontal axis between an operative position in which the mud share rests against the steel share and at least a portion of the mud share is disposed below the lower edge of the steel share and an inoperative position in which the mud share is disposed above and rearwardly of the lower edge of the steel share; a hydraulic piston and cylinder device for swinging the mud share between the operative and inoperative position and for retaining the mud share in its operative position, the device being hydraulically connected to an overflow valve which is adjustable to a predetermined pressure for permitting the mud share to swing upwardly and rearwardly when it meets an obstacle.

8 Claims, 4 Drawing Figures

COMBINATION PLOUGH

This invention relates to a plough, preferably for clearing away snow, comprising at least one wing, which is provided with a steel share possibly divided into a plurality of separate sections, each of which, for example when striking against an obstacle, individually can be pivoted from its operating position against the action of one one or several power units, which exert a predetermined force.

Such ploughs with steel shares are known previously, and as supplement for such ploughs so-called sludge-ploughs are available, which instead of with steel shares are equipped with a rubber share or so-called sludge-share of wear rubber or like material, which does not subject the road surface of asphalt, oil gravel and similar material to wear as high as a steel share does, and which therefore can be applied directly to such surfacing materials in order to clean them from snow sludge, snow mud, sand etc. Steel shares, however, cannot be used for this purpose. The sludge-plough, thus, is intended especially for use at mild weather or in such cases when the road is in such condition that the permanent surface is exposed or will be exposed at ploughing. The wear on the road surface is thereby reduced substantially, in any case when compared with the use of steel share ploughs at the same state of weather. The steel shares, moreover, also are subjected to exceptional wear and, therefore, must be repaired and/or exchanged very often. It happens frequently, however, that at least within larger districts covering up to between 100 and 150 kilometers the weather changes from one type to another, for example from cold to mild weather, within a single ploughing drive, so that at least the roads with heavy traffic soon become muddy. In such cases the snow-plough must return to the starting place or depot in order to get the ploughshare replaced. This is unrational, tedious and delays the ploughing work.

In order to avoid these unnecessary return trips, it has been tried to equip the steel share ploughs with a detached mud share, rendering it possible to exchange the steel share against a mud share, and vice versa. Such replacements in the field, however, have proved to be complicated and time-consuming, so that thereby no time was gained compared with driving back to the starting place or to a nearby workshop for carrying out the replacement there.

The present invention, therefore, has the object to eliminate these drawbacks by providing a plough of the kind referred to above in the introductory portion, which plough is designed so as to permit exchange from steel share to mud share or from mud share to steel share without any tools and preferably directly from the driver's cab without requiring the driver to leave the cab.

This object is achieved thereby that the plough according to the invention has been given the characterizing features defined in the attached claims.

Figure 1:
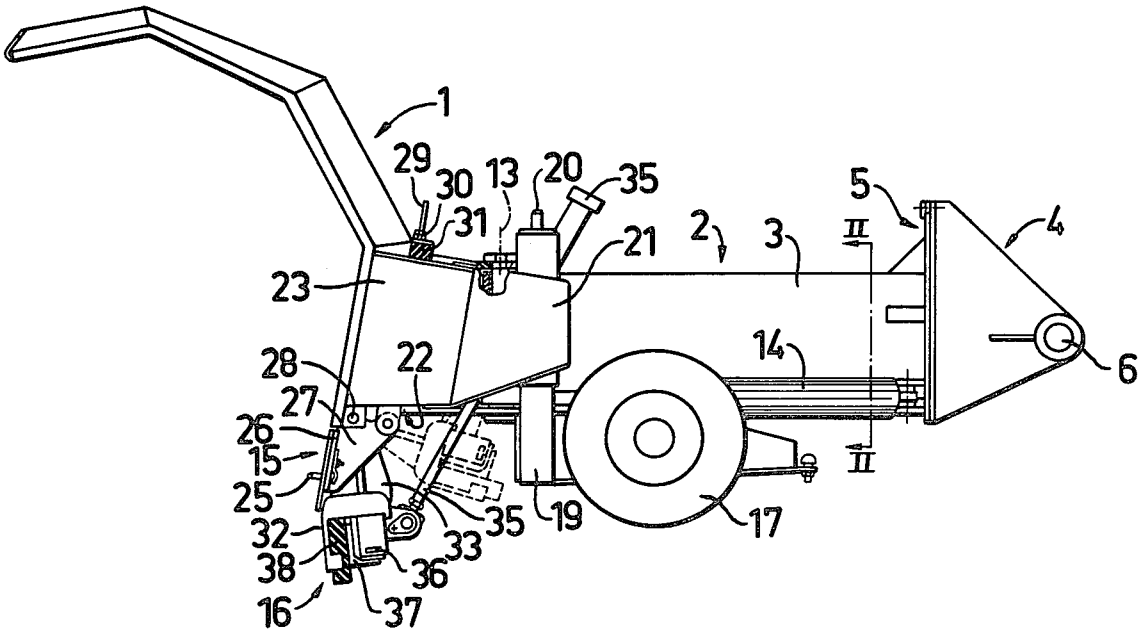
Figure 2:
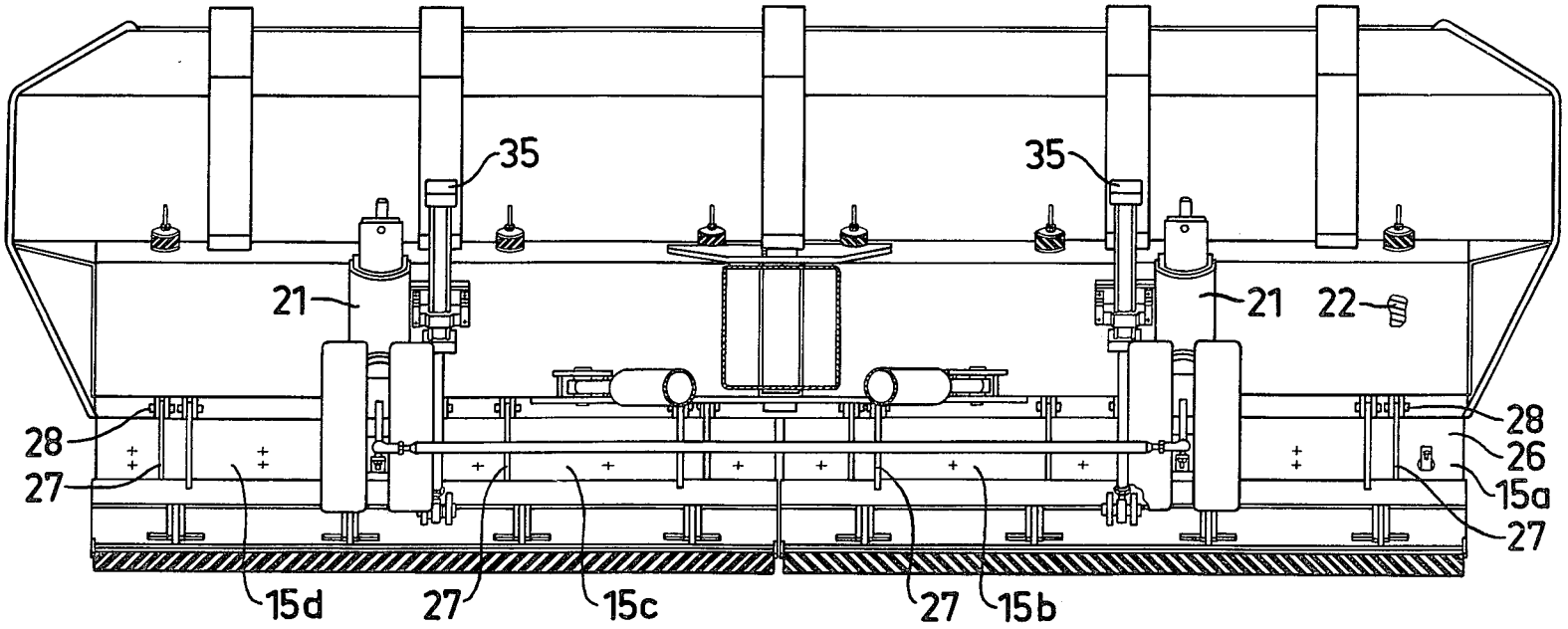
Figure 3:
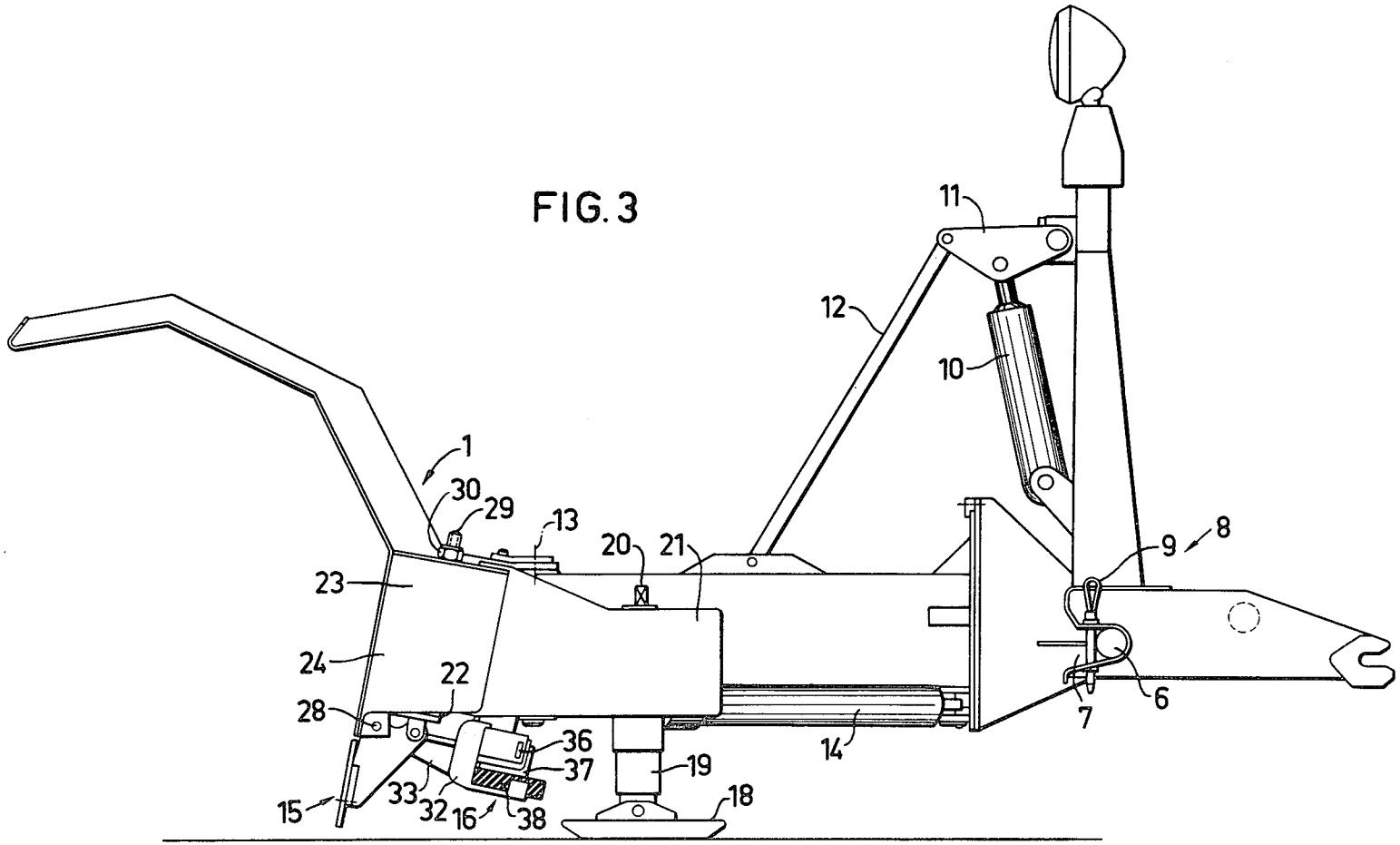
Figure 4:
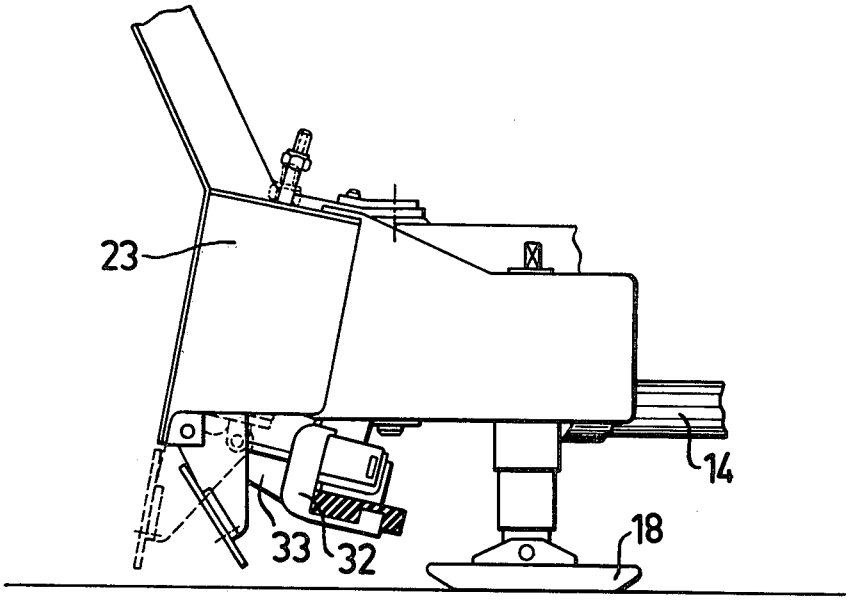

The invention is described in greater detail in the following, with reference to the accompanying drawings, in which FIG. 1 is a lateral view of an embodiment of the plough, FIG. 2 is a section along the line II—II in FIG. 1, FIG. 3 is a schematic lateral view of an embodiment only slightly modified and showing the attachment of a plough according to the invention to a vehicle mounting, FIG. 4 is a lateral view of a portion of the plough in FIG. 3 for illustrating the position of the steel share resiliently moved out of the way.

Although the plough according to the invention may be of any type, it is shown in the drawings in the form of a diagonal plough with a wing 1 and a frame structure 2, which consists of a so-called sliding gate 3 and a mounting 4, at which the sliding gate is mounted rotatably to a limited extent by means of a turntable 5. The mounting 4 is provided with axle journals 6, which as shown in greater detail in FIG. 3 are received in recesses 7 of a mounting 8 supported on a vehicle and are retained in these recesses by cotter pins 9. The plough, as appears more clearly from FIG. 3, can be lifted and lowered about its axle journals 6 by means of a piston-cylinder device 10, which acts between the vehicle mounting 8 and a link member 11 pivoted thereon, which link member is connected to the plough structure 2 by a stay member 12, preferably in the form of a chain. This piston-cylinder device 10 is maintained during the ploughing operation in so-called floating position, in which the plough is permitted to move freely so as to adapt to the road and its bumpy surface without being obstructed by the piston-cylinder device 10.

The plough wing 1 is supported at the forward portion of the structure 2 by means of a vertical shaft, which is indicated only schematically in the drawings by a dashed line 13, and about which the wing 1 can be pivoted by means of piston-cylinder devices 14 located on both sides of the structure 2 to be given a desired angular position relative to the driving direction. The plough is shown in the drawings with its wing 1 set transverse to the driving direction, i.e. in a position perpendicular to said direction.

According to the invention, the wing 1 is provided with both a steel share 15 and a rubber share or mud share 16 consisting of wear rubber or a corresponding material. In FIG. 1 the rubber share 16 is shown in operative position, in which the plough with its entire load presses the share against the ground, and in FIG. 3 the steel share 15 is shown in its operative position, in which the plough is supported against the ground by legs 19, which are provided either with pivot wheels, mechanically guided wheels 17 (FIG. 1) or slide plates 18 (FIG. 3) and can be vertically adjusted by a screw 20 indicated only schematically in the drawings, which screw extends through the legs for setting the steel share 15 in correct position relative to the ground. Distinguished from the rubber 16, the steel share 15 must not directly abut the road surface, but be maintained slightly above the same, as shown in FIG. 1. The legs 19 are attached to box-shaped arms 21 extending rearward from the wing 1 and located spaced from the structure 2 and the pivotal shaft 13 of the wing in order not to obstruct the wing to be angularly adjusted to the desired diagonal position.

The steel share 15, as appears especially from FIGS. 1 and 2, is divided into a plurality (at the embodiment shown four) separate sections **15*a*,15*b* a.s.o, each of which can be pivoted aside individually against the action of one or more power units exerting a predetermined force. The power units may be spring packages 22 disposed in a box structure 23, the front side of which constitutes the straight, but slightly rearward inclined portion 24 of the wing, of which portion the steel share 15** is a direct continuation. Every steel share section 15*a*, 15*b* a.s.o. is attached easily removably, for example by a wedge-lock 25, to a support plate 26, which is rigidly connected to a number of arms 27. Said arms are pivotally mounted about shafts 28 provided at the lower portion of the wing and in spaced relationship to the mounting point 28 pivotally connected each with a spring package 22. Each such spring package comprises a through rod 29, which is connected to an associated arm 27 and at its portion extending above the box structure 23 is provided with a set nut 30, by which the angle of inclination to the ground of the steel share can be adjusted and which, by co-operation with said upper surface, between which and the set nut 30 a dampening cushion 31 of rubber or another resilient material may be located, as shown in FIGS. 1 and 2, limits the pivotal movement of the steel share in clockwise direction about the shafts 28. Every steel share section, thus, is retained in its operative position by its spring package 22, which however permits the respective steel share section to be swung out of the way, for example when it meets an obstacle in the road surface, in counterclockwise direction to the position shown in FIG. 4. This out of the way movement can take place without obstruction by the mud share 16, which when the steel share 15 is in operation is retained in its folded-up position, as shown by fully drawn lines in FIGS. 3 and 4 and by dashed lines in FIG. 1.

The mud share 16 at the embodiments shown comprises two sections, each provided in a holder 32, which at the embodiments shown are supported by arms 33. Said arms are pivotally mounted about shafts 34 located at the lower portion of the wing. The shafts 34 may but need not necessarily align with the shafts 28 of the steel share sections. The holders 32 are actuated each by at least one piston-cylinder device 35 secured at the box-structure 23 or at the arms 21 extending rearward therefrom, by means of which devices the mud share sections, preferably after the plough has been lifted by the lifting cylinder 10, are swung into and out of operative position shown in FIGS. 1 and 2 and thereby permit share exchange. When the mud share 16 has been pivoted forward from its folded-up position shown in FIGS. 3 and 4 to the operative position shown in FIGS. 1 and 2, the plough again is lowered so as with its entire load to rest against the road surface with the mud share 16, i.e. in operative position of the mud share the wheels or slide plates are lifted off the road surface, as shown in FIG. 1.

The mud share 16 in operative position is located below the steel share 15 and in this position shall form a right angle with the road surface, or preferably be slightly forwardly inclined, distinguished from the slightly rearwardly inclined steel share 15, in order to prevent the plough from bouncing forward. In its operative position the mud share 16 rests against the rear surface of the support plates 26 of the steel share with its arms 33 and is retained in this position by the piston-cylinder devices 35, which are connected to overflow valves, which are adjustable to a predetermined pressure, in order to enable the mud share 16 to move out of the way when it meets an obstacle. The hydraulic circuit of the piston-cylinder devices may also include an accumulator. Furthermore, special stop members may be provided to determine the operative position of the mud share and, respectively, the position at which the steel share assumes its operative position.

Every mud share section is adjustably mounted in the respective holder 32 by means of wedges 36, which by pressure irons 37 in parallel with the mud share clamp the mud share against the surface 38 of the holder which is in parallel with the pressure iron and the mud share. When the mud share is worn, it can be lowered slightly in its holder, so that each mud share can be utilized at maximum.

At the embodiment shown in FIGS. 1 and 2 and provided with wheels 17, a tie rod 40 is provided between the wheels 17 for steering the same, which tie rod, though not shown in the drawings, can be coupled to the plough structure in order to correctly position the wheels in relation to different diagonal positions of the wing.

The present invention is not restricted to what is described above and shown in the drawings, but can be altered and modified in many different ways within the scope of the invention idea defined in the attached claims.

What we claim is:

1. In a plough assembly of the kind which during use is raised and lowered relative to a surface to be ploughed or cleared: a wing having a forwardly facing surface and a lower edge; a steel share carried by said wing adjacent the lower edge thereof, said steel share having a lower scraping edge permanently disposed below the lower edge of said wing, said steel share comprising a plurality of sections arranged end-to-end and means mounting each section for swinging movement in a vertical plane about a generally horizontal axis whereby each section can swing upwardly and rearwardly when meeting an obstacle; a mud share pivotally connected to said wing for swinging movement about a generally horizontal axis between an operative position in which at least a portion of said mud share is disposed below the lower edge of said steel share and an inoperative position in which said mud share is disposed above and rearwardly of the lower edge of said steel share, and means for swinging said mud share between said operative and inoperative position.

2. A plough assembly as in claim 1 wherein said mud share comprises a plurality of sections arranged end-to-end, each of said sections being pivotally connected to said wing for said swinging movement, and wherein said swinging means operates to swing each of said sections between said operative and said inoperative position.

3. A plough assembly as in claim 2 wherein said swinging means includes a hydraulic piston and cylinder device associated with each of said sections.

4. A plough assembly as in claim 2 wherein said mud share in its operative position rests against said steel share and is retained in this position by said hydraulic piston and cylinder devices.

5. A plough assembly as in claim 1 wherein said mud share in its operative position rests against said steel share and is retained in this position by said swinging means.

6. A plough assembly as in claim 3 wherein said piston and cylinder device is hydraulically connected to an overflow valve which is adjustable to a predetermined pressure for permitting the mud share to swing upwardly and rearwardly when it meets an obstacle.

7. A plough assembly as in claim 1 wherein said mud share is adjustably mounted in a holder so that as the lower edge of said mud share becomes worn said mud share may be extended from said holder.

8. In a plough assembly of the kind which during use is raised and lowered relative to a surface to be ploughed or cleared: a wing having a forwardly facing surface and a lower edge; a steel share carried by said wing adjacent the lower edge thereof, said steel share having a lower scraping edge permanently disposed below the lower edge of said wing; a mud share pivotally connected to said wing for swinging movement about a generally horizontal axis between an operative position in which said mud share rests against said steel share and at least a portion of said mud share is disposed below the lower edge of said steel share and an inoperative position in which said mud share is disposed above and rearwardly of the lower edge of said steel share; a hydraulic piston and cylinder device for swinging said mud share between said operative and inoperative position and for retaining said mud share in its operative position, said device being hydraulically connected to an overflow valve which is adjustable to a predetermined pressure for permitting the mud share to swing upwardly and rearwardly when it meets an obstacle.

* * * * *